US011930863B2

(12) United States Patent
Nezaj

(10) Patent No.: US 11,930,863 B2
(45) Date of Patent: Mar. 19, 2024

(54) ANTI-SLIP DEVICE

(71) Applicant: Valerije Nezaj, North Salem, NY (US)

(72) Inventor: Valerije Nezaj, North Salem, NY (US)

( * ) Notice: Subject to any disclaimer, the term of this patent is extended or adjusted under 35 U.S.C. 154(b) by 134 days.

(21) Appl. No.: 16/522,886

(22) Filed: Jul. 26, 2019

(65) Prior Publication Data

US 2021/0022412 A1 Jan. 28, 2021

(51) Int. Cl.
*A41B 11/00* (2006.01)
*A43B 13/22* (2006.01)

(52) U.S. Cl.
CPC ..... *A41B 11/008* (2013.01); *A43B 13/22* (2013.01)

(58) Field of Classification Search
CPC ..... A41B 11/008; A41B 11/00; A41B 11/007; A43B 13/22; A43B 13/223; A43B 13/26; A43B 13/28; A43B 13/32; A43B 3/0005; A43B 7/00; A43B 7/02; A43B 7/025
USPC ..... 2/239, 240, 241
See application file for complete search history.

(56) References Cited

U.S. PATENT DOCUMENTS 5,768,802 A * 6/1998 Bramani ..... A43B 7/146 36/35 R
7,051,457 B1 * 5/2006 Huggins ..... A41B 11/004 2/238
8,356,426 B1 * 1/2013 Daniel ..... A43B 13/16 36/15
2006/0112591 A1 * 6/2006 Lombardo ..... A43C 15/02 36/7.5
2007/0006489 A1 * 1/2007 Case ..... A43D 1/027 36/132
2007/0161920 A1 * 7/2007 Chiodo ..... A43B 7/147 600/546
2011/0314706 A1 * 12/2011 French ..... C08L 23/0853 36/59 R
2012/0066938 A1 * 3/2012 French ..... A43B 13/14 36/25 R
2016/0120733 A1 * 5/2016 Ishikawa ..... A43B 3/34 36/43
2017/0208890 A1 * 7/2017 Torvinen ..... H02N 2/181
2018/0317565 A1 * 11/2018 McCuaig ..... A41B 11/008
2019/0008231 A1 * 1/2019 Grimberg ..... A43B 5/18
2019/0287374 A1 * 9/2019 Harsdorff ..... G08B 21/043
2020/0329782 A1 * 10/2020 Kim ..... A41B 11/007
2020/0397065 A1 * 12/2020 Jackson ..... A41B 11/008

* cited by examiner

*Primary Examiner* — Jocelyn Bravo
(74) *Attorney, Agent, or Firm* — The Iwashko Law Firm, PLLC; Lev Ivan; Gabriel Iwashko

(57) ABSTRACT

An anti-slip device, including at least one main body, including an outer surface to resist movement across a ground surface, and an inner surface to connect to footwear.

3 Claims, 1 Drawing Sheet

ANTI-SLIP DEVICE

BACKGROUND

1. Field

The present general inventive concept relates generally to an anti-slip device, and particularly, to an anti-slip device for footwear.

2. Description of the Related Art

Traditional socks do not offer the support needed for a person walking on smooth surfaces on a constant basis. Generally, traditional socks are inserted within footwear.

However, in practice, many people wear socks regardless of the purpose. In other words, socks are often worn for comfort and may be used indoors and outdoors without further equipping footwear. Unfortunately, this practice can result in injuries because the person may inadvertently fall and hurt themselves because of a lack of traction on the socks.

Therefore, there is a need for an anti-slip device for footwear to prevent injuries while wearing socks.

SUMMARY

The present general inventive concept provides an anti-slip device.

Additional features and utilities of the present general inventive concept will be set forth in part in the description which follows and, in part, will be obvious from the description, or may be learned by practice of the general inventive concept.

The foregoing and/or other features and utilities of the present general inventive concept may be achieved by providing an anti-slip device, including at least one main body, including an outer surface to resist movement across a ground surface, and an inner surface to connect to footwear.

The outer surface may be a smooth surface that increases friction across the ground surface.

The outer surface may be a textured surface that increases friction across the ground surface.

The anti-slip device may further include a piezoelectric transducer disposed within at least a portion of the at least one main body to release a viscous liquid on the outer surface in response to a detection of sliding across the ground surface.

BRIEF DESCRIPTION OF THE DRAWINGS

These and/or other features and utilities of the present generally inventive concept will become apparent and more readily appreciated from the following description of the embodiments, taken in conjunction with the accompanying drawings of which.

DETAILED DESCRIPTION

Various example embodiments (a.k.a., exemplary embodiments) will now be described more fully with reference to the accompanying drawings in which some example embodiments are illustrated. In the figures, the thicknesses of lines, layers and/or regions may be exaggerated for clarity.

Accordingly, while example embodiments are capable of various modifications and alternative forms, embodiments thereof are shown by way of example in the figures and will herein be described in detail. It should be understood, however, that there is no intent to limit example embodiments to the particular forms disclosed, but on the contrary, example embodiments are to cover all modifications, equivalents, and alternatives falling within the scope of the disclosure. Like numbers refer to like/similar elements throughout the detailed description.

It is understood that when an element is referred to as being "connected" or "coupled" to another element, it can be directly connected or coupled to the other element or intervening elements may be present. In contrast, when an element is referred to as being "directly connected" or "directly coupled" to another element, there are no intervening elements present. Other words used to describe the relationship between elements should be interpreted in a like fashion (e.g., "between" versus "directly between," "adjacent" versus "directly adjacent," etc.).

The terminology used herein is for the purpose of describing particular embodiments only and is not intended to be limiting of example embodiments. As used herein, the singular forms "a," "an" and "the" are intended to include the plural forms as well, unless the context clearly indicates otherwise. It will be further understood that the terms "comprises," "comprising," "includes" and/or "including," when used herein, specify the presence of stated features, integers, steps, operations, elements and/or components, but do not preclude the presence or addition of one or more other features, integers, steps, operations, elements, components and/or groups thereof.

Unless otherwise defined, all terms (including technical and scientific terms) used herein have the same meaning as commonly understood by one of ordinary skill in the art to which example embodiments belong. It will be further understood that terms, e.g., those defined in commonly used dictionaries, should be interpreted as having a meaning that is consistent with their meaning in the context of the relevant art. However, should the present disclosure give a specific meaning to a term deviating from a meaning commonly understood by one of ordinary skill, this meaning is to be taken into account in the specific context this definition is given herein.

LIST OF COMPONENTS

Anti-Slip Device 100
Main Body 110
Outer Surface 111
Inner Surface 112
Piezoelectric Transducer 120
Motion Sensor 121
Viscous Liquid Container 122

Figure 1:
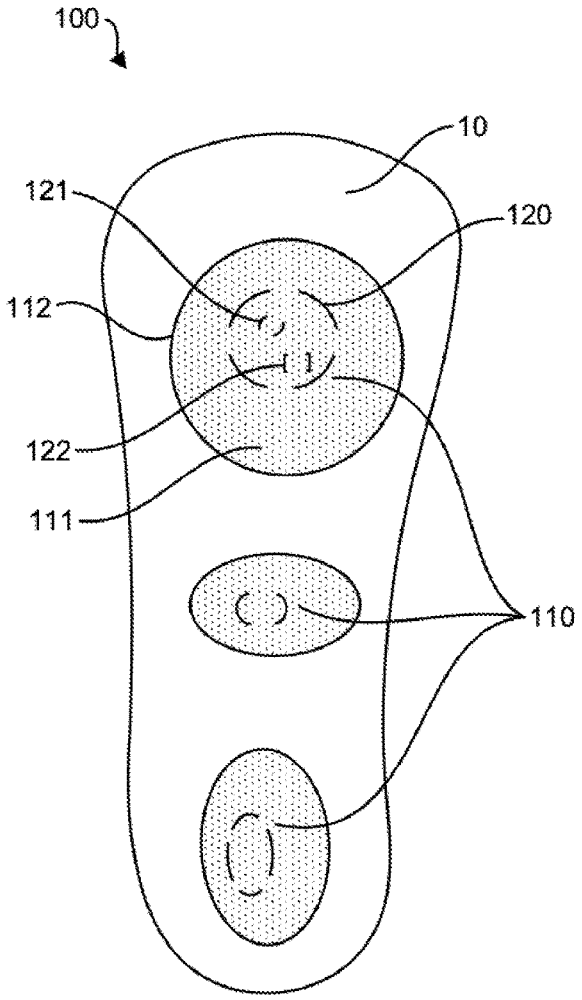
FIG. 1 illustrates a top view of an anti-slip device disposed on footwear, according to an exemplary embodiment of the present general inventive concept.

FIG. 1 illustrates a top view of an anti-slip device 100 disposed on footwear 10, according to an exemplary embodiment of the present general inventive concept.

The anti-slip device 100 may be constructed from at least one of metal, plastic, glass, and rubber, etc., but is not limited thereto. Additionally, the anti-slip device 100 may be highly durable to resist high impact on at least a portion thereof.

Figure 2:
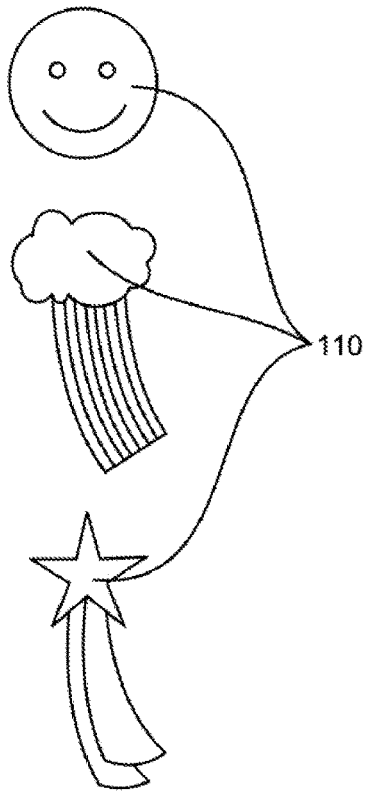
FIG. 2 illustrates different shapes of at least one main body, according to an exemplary embodiment of the present general inventive concept.

FIG. 2 illustrates different shapes of at least one main body 110, according to an exemplary embodiment of the present general inventive concept.

The anti-slip 100 may include at least one main body 110 and a piezoelectric transducer 120, but is not limited thereto.

Referring to FIG. 1, the at least one main body 110 is illustrated to have an oval shape. However, referring to FIG. 2, the at least one main body 110 may be a rectangular prism, rectangular, circular, pentagonal, hexagonal, octagonal, or any other design and/or shape known to one of ordinary skill in the art, but is not limited thereto.

Additionally, the at least one main body 110 may have any color based on a preference of a user.

The at least one main body 110 may include an outer surface 111 and an inner surface 112, but is not limited thereto.

The outer surface 111 may include a smooth surface and/or a textured surface, such as a plurality of bubbled protrusions extending away therefrom, such that the textured surface may resist movement across a ground surface. In other words, the textured surface of the outer surface 111 may increase friction to resist movement across the ground surface.

Alternatively, the smooth surface of the outer surface 111 may be a rubber surface to increase friction across the ground surface.

The inner surface 112 may include an adhesive disposed thereupon, such as a glue, a tape, and/or any other combination thereof, such that the inner surface 112 may be connected to a footwear 10. In other words, the inner surface 112 may be removably disposed to the footwear 10, such as socks and/or slippers. As such, the at least one main body 110 may prevent injury to a user in response to connecting the at least one main body 110 to the footwear 10.

The piezoelectric transducer 120 may include a motion sensor 121 and a viscous liquid container 122, but is not limited thereto.

The piezoelectric transducer 120 may be constructed of barium titanate, quartz lithium tantalite, and/or any other crystal capable of creating electricity as a result of force or pressure applied thereto. Furthermore, the piezoelectric transducer 120 may be disposed within at least a portion of the at least one main body 110, such that the user may be unable to feel its presence.

The motion sensor 121 may receive electrical energy in response to movement upon the at least one main body 110, such that the piezoelectric transducer 120 may generate electrical energy in response to pressure being applied thereto. Also, the motion sensor 121 may detect rapid movement, such as sliding across the ground surface.

The motion sensor 121 may trigger the viscous liquid container 122 to rupture and/or eject viscous liquid on the outer surface 111 in response to a detection of rapid sliding across the ground surface, such as movement that does not include walking and/or otherwise making steps. In other words, the viscous liquid container may release the viscous liquid to increase friction, such that the at least one main body 110 may be prevented from sliding across the ground surface.

The present general inventive concept may include an anti-slip device 100, including at least one main body 110, including an outer surface 111 to resist movement across a ground surface, and an inner surface 112 to connect to footwear 10.

The outer surface 111 may be a smooth surface that increases friction across the ground surface.

The outer surface 111 may be a textured surface that increases friction across the ground surface.

The anti-slip device 100 may further include a piezoelectric transducer 120 disposed within at least a portion of the at least one main body 110 to release a viscous liquid on the outer surface 111 in response to a detection of sliding across the ground surface.

Although a few embodiments of the present general inventive concept have been shown and described, it will be appreciated by those skilled in the art that changes may be made in these embodiments without departing from the principles and spirit of the general inventive concept, the scope of which is defined in the appended claims and their equivalents.

The invention claimed is:

1. A sock having an anti-slip device for the sock, the anti-slip device comprising:

a plurality of main bodies distanced from each other and having different sizes and shapes with respect to each other, such that each of the plurality of main bodies has a boundary that is separate and distinct from the sock prior to connecting to the sock and maintains a shape of the sock after connecting to the sock, each of the plurality of main bodies comprising:

an outer surface comprising a plurality of bubbled protrusions extending away from a portion of the outer surface to resist movement across a ground surface, wherein the plurality of bubbled protrusions are configured to resist high impact, and an inner surface to connect directly to the sock, such that there is no intervening object disposed between the inner surface and the sock;

a motion sensor disposed within at least a portion of each of the plurality of main bodies to compare a type of movement between sliding and making steps, wherein the motion sensor is disposed within each of the plurality of main bodies without a presence of the motion sensor being felt by a wearer; and a piezoelectric transducer and a viscous liquid container disposed within at least a portion of each of the plurality of main bodies, wherein the motion sensor is configured to trigger the viscous liquid container to release a viscous liquid on the outer surface in response to a detection of sliding across the ground surface.

2. The sock of claim 1, wherein the outer surface is a rubber surface that is configured to increase friction across the ground surface.

3. The sock of claim 1, wherein the outer surface is a textured surface that is configured to increase friction across the ground surface.

* * * * *